US012398492B2

(12) United States Patent
Leksa et al.

(10) Patent No.: US 12,398,492 B2
(45) Date of Patent: Aug. 26, 2025

(54) WORKSTATION OF A TWO-FOR-ONE TWISTING OR CABLING MACHINE FOR THE PRODUCTION OF CARPET YARN

(71) Applicant: Saurer Technologies Gmbh & Co. KG, Krefeld (DE)

(72) Inventors: Helmut Leksa, Lake Wylie, SC (US); Georg Tetzlaff, Aachen (DE)

(73) Assignee: Saurer Technologies GmbH & Co. KG, Krefeld (DE)

( * ) Notice: Subject to any disclaimer, the term of this patent is extended or adjusted under 35 U.S.C. 154(b) by 0 days.

(21) Appl. No.: 16/185,103

(22) Filed: Nov. 9, 2018

(65) Prior Publication Data

US 2019/0145026 A1 May 16, 2019

(30) Foreign Application Priority Data

Nov. 10, 2017 (DE) ..... 20 2017 106 858.7

(51) Int. Cl.
*D02G 3/38* (2006.01)
*D01H 1/10* (2006.01)
(Continued)

(52) U.S. Cl.
CPC ..... *D02G 3/38* (2013.01); *D01H 1/10* (2013.01); *D01H 7/86* (2013.01); *D01H 13/00* (2013.01);
(Continued)

(58) Field of Classification Search
CPC ..... A01H 7/86; A01H 7/862; A01H 7/864; A01H 7/866; D02G 3/38
See application file for complete search history.

(56) References Cited

U.S. PATENT DOCUMENTS 3,529,323 A * 9/1970 Hughey ..... D02G 1/0266 425/71
3,688,998 A * 9/1972 Carr ..... B65H 67/052 242/474.4
(Continued)

FOREIGN PATENT DOCUMENTS

CN 101287664 A 10/2008
CN 104891272 A 9/2015
(Continued)

OTHER PUBLICATIONS

Examination Report from Turkish Patent Application No. 2018/16871, issued Sep. 16, 2022, all enclosed pages cited.
(Continued)

*Primary Examiner* — Bao-Thieu L Nguyen
(74) *Attorney, Agent, or Firm* — Nelson Mullins Riley & Scarborough LLP

(57) ABSTRACT

Workstation of a two-for-one twisting or cabling machine for production of carpet yarn, including winding device having package cradle with two frame arms for rotatable mounting of an empty tube or twisting package, package drive roller for frictionally driving twisting package, yarn traversing device for traversing transfer of a yarn to the twisting package, advance roller for regulating a yarn tension, and cover in area of the advance roller with an opening for yarn guided through the yarn traversing device to the twisting package. Package cradle has at least one movable, partially rotatable frame arm and designed so an empty tube with length of at least 315 mm is insertable, that the package drive roller has length of at least 286 mm, that yarn traversing device has traversing stroke of at least 11 inches, and that opening in cover corresponds with the yarn path arising due to the traversing stroke.

9 Claims, 3 Drawing Sheets

(51) Int. Cl.

| | |
|---|---|
| ***D01H 7/86*** | (2006.01) |
| ***D01H 13/00*** | (2006.01) |
| ***D02G 3/28*** | (2006.01) |
| ***D02G 3/44*** | (2006.01) |

(52) U.S. Cl.
CPC ..... *D02G 3/28* (2013.01); *D02G 3/445* (2013.01); *D10B 2503/04* (2013.01)

(56) References Cited

U.S. PATENT DOCUMENTS

| | | | | | |
|---|---|---|---|---|---|
| 3,982,707 | A * | 9/1976 | Saleeby | B65H 54/34 | 242/476.4 |
| 4,132,372 | A * | 1/1979 | Worrell | B65H 49/327 | 242/129.62 |
| 4,139,162 | A * | 2/1979 | Stahlecker | B65H 67/04 | 242/473.6 |
| 4,300,345 | A * | 11/1981 | Kasai | B65H 55/00 | 242/470 |
| 4,324,368 | A * | 4/1982 | Inouye | B65H 54/34 | 242/476.1 |
| 4,603,818 | A * | 8/1986 | Luz | B65H 54/34 | 242/473.6 |
| 4,757,677 | A * | 7/1988 | Smith | D01H 4/48 | 57/263 |
| 4,928,475 | A * | 5/1990 | Matsui | B65H 54/26 | 242/473.5 |
| 4,948,057 | A * | 8/1990 | Greis | B65H 54/28 | 242/473.8 |
| 5,107,668 | A * | 4/1992 | Dammann | B65H 54/71 | 242/473.5 |
| 5,423,170 | A * | 6/1995 | Dammann | B65H 54/34 | 57/305 |
| 5,806,775 | A * | 9/1998 | Smith | B65H 54/2812 | 242/178 |
| 6,186,435 | B1 * | 2/2001 | Mayer | B65H 59/385 | 242/477.2 |
| 7,163,174 | B2 * | 1/2007 | Lieber | B65H 54/2821 | 242/477.2 |
| 7,513,021 | B1 * | 4/2009 | Haselwander | D01H 7/86 | 28/247 |
| 8,033,089 | B2 * | 10/2011 | Leupers | D02G 3/285 | 57/58.52 |
| 10,494,742 | B2 * | 12/2019 | Duralti | D01H 1/10 | |
| 10,519,572 | B2 * | 12/2019 | Yang | D01H 13/02 | |
| 2005/0082404 | A1 * | 4/2005 | Beckmann | D01H 1/18 | 242/129 |
| 2010/0199625 | A1 * | 8/2010 | Leupers | D02G 3/285 | 57/354 |
| 2011/0017855 | A1 * | 1/2011 | King | B65H 49/38 | 242/130.4 |
| 2013/0074468 | A1 * | 3/2013 | Guggemos | B65H 67/064 | 57/58.83 |
| 2019/0010632 | A1 * | 1/2019 | Yang | D01H 13/02 | |

FOREIGN PATENT DOCUMENTS

| | | | |
|---|---|---|---|
| CN | 107299422 | A | 10/2017 |
| CN | 207582031 | U | 7/2018 |
| CN | 209669411 | U | 11/2019 |
| DE | 102006061290 | A1 | 6/2008 |
| DE | 102014002882 | A1 | 9/2015 |

OTHER PUBLICATIONS

Office Action from Chinese Patent Application No. 201811337255.1, issued Jan. 4, 2021, all enclosed pages cited.
Office Action from Chinese Patent Application No. 201811337255.1, issued Apr. 2, 2021, all enclosed pages cited.
"China Textile Machinery Selection Guide", Kong Qingfu, Beijing: China Textile Press, first edition, May 1999, translation of p. 218 cited and enclosed.

* cited by examiner

WORKSTATION OF A TWO-FOR-ONE TWISTING OR CABLING MACHINE FOR THE PRODUCTION OF CARPET YARN

CROSS-REFERENCE TO RELATED APPLICATIONS

This application claims priority from German National Patent Application 20 2017 106 858.7, filed Nov. 10, 2017, the entire contents of which are incorporated herein by reference.

FIELD OF THE INVENTION

The invention relates to a workstation of a two-for-one twisting or cabling machine for the production of carpet yarn, more particularly a two-for-one twisting or cabling machine with such a workstation as well as a method for operating a two-for-one twisting or cabling machine.

BACKGROUND OF THE INVENTION

Twisting or cabling or cording is a mechanical yarn-finishing method for producing certain usage properties in the twisted yarn. While two or more yarns are merged into a twisted yarn by twisting in the two-for-one twisting method, cabling is a special twisting method in which two yarns are twisted together without the individual yarns themselves receiving a twist. The advantage of twisting lies in the higher tensile strength.

In the context of the present application, the term "yarn" encompasses all linear constructions, such as yarns, film bands, tubular and strip-shaped textiles and the like. For simplification, the term "yarn" is used to mean the possible alternatives in the context of the present application.

A cabling machine, for example, typically has a variety of workstations arranged adjacent to each other in the machine longitudinal direction. The workstations each comprise a spindle, onto which a feed package is slid, and a slide-on device, which is arranged on the machine frame and which serves to hold a second feed package. The yarns are pulled from the feed packages and kept at constant tension by yarn brakes, cabled and wound onto a twisting package in a winding unit.

During the operation of the cabling spindle, the first feed package is arranged on the rotating spindle in a spindle pot. However, the spindle pot and the feed package itself are secured against rotation. A so-called inner yarn is pulled axially upward from said first feed package and, on the way to the point of cabling or point of combination with the outer yarn, is led through an inner yarn brake.

The second feed package, from which the outer yarn is pulled, is arranged in a creel. After the outer yarn has passed an outer yarn brake and optionally a deflecting device, the outer yarn enters the hollow spindle axially from below and exits the spindle at the perimeter of a storage disc. The outer yarn rotates around the spindle pot, a yarn balloon being formed, and is led to the balloon yarn guide. At this location, the outer yarn is wound around the inner yarn, and therefore this is also called the point of cabling.

A pull-off device is arranged above the point of cabling, by means of which pull-off device the yarn, which is also known as the cord is pulled off and fed by means of a balancing element, such as a dancer, to a winding device. The winding device has a drive roller, a yarn traversing device and a cabling or take-up package frictionally driven by the drive roller.

For carpet yarns, usually take-up packages with a pre-specified diameter of a maximum of approx. 400 mm are produced. These standard dimensions of the take-up packages, which become feed packages in the downstream processes and for this reason continue to be designated as twisting packages, result from the maximum diameters to be processed in the downstream processing steps, such as heat setting, weaving or tufting, since the attachments in the feed creels for further processing of the twisting package are designed for a maximum diameter of approx. 400 mm.

The cylindrical empty tubes for producing the twisting packages are also standardized and have an inner diameter of 73 mm and a length of 290 mm. They are wound with a so-called traversing stroke of a standard 10 inches. In this context, the traversing stroke designates the extent of the traversing motion, i.e. the oscillating motion between two extreme positions.

This means that the weight and the associated running length of the twisting packages, besides the material-dependent density parameters which can be considered insignificant here, can essentially only be influenced by the package diameter.

Due to the standardized empty tubes and twisting packages, the running lengths of the twisting packages in the downstream further processing steps are limited. An increase of the twisting package diameter is not practicable, since the creels of the downstream further processes are restricted to a package diameter of approx. 400 mm. An increase in the winding density of the twisting packages to increase the running length is just as impracticable for quality reasons, as an increase in the winding density negatively influences not only the yarn properties, such as the fine rippling of the wound yarn, but also the running behavior of the yarn from the twisting package.

This means that the demand of the further processing industry for increased running lengths for the twisting packages cannot be fulfilled without costly construction and conversion measures within the further processing machines.

DE 10 2014 002 882 A1 discloses a workstation of a two-for-one twisting machine. The yarn is guided to an advance roller via a wrapping roller for winding onto the take-up package. At the advance roller, the yarn tension is lowered to a point tolerable for winding. The yarn now runs into a yarn traversing device designed here as a traversing yarn guide, which transfers the yarn in a transverse manner to a take-up or twisting package to be wound, here specifically a cross-wound package. The cross-wound package is driven through friction via a friction roller. The advance rollers and the friction rollers of the workstations are each positioned on a separate machine-length drive shaft.

SUMMARY OF THE INVENTION

A first aspect of the invention therefore comprises a workstation of a two-for-one twisting or cabling machine for the production of carpet yarn, including a winding device that has a package cradle with two frame arms for the rotatable mounting of an empty tube or twisting package, a package drive roller for frictionally driving the twisting package, a yarn traversing device for the traversing of a yarn to the twisting package, an advance roller for regulating yarn tension as well as a cover in the area of the advance roller with an opening for the yarn guided through the yarn traversing device.

The suggested workstation is characterized in that the package cradle has at least one movable, partially rotatable frame arm and is designed so that an empty tube with a length of at least 315 mm is insertable, that the package drive roller has a length of at least 286 mm, that the yarn traversing device has a traversing stroke of at least 11 inches, and that the opening in the cover corresponds with the yarn path arising due to the traversing stroke.

Twisting packages for carpet yarns that have an increased running length can be produced using a workstation designed in such a way. An increased running length of the twisting package not only means longer processing running times for the cabling or twisting process itself, but also longer process running times in the downstream further processing steps. This means fewer interruptions, for example for switching intervals, are required.

While retaining the empty tube inner diameter and the maximum possible twisting package diameter that are standard for the carpet yarn sector, the twisting packages are significantly increased in the process chain of carpet yarn production or their further processing with regard to the take-up format and the take-up quantity, without having to undertake technical and/or construction changes in the following process steps of the two-for-one twisting or cabling machine.

In order to be able to mount longer empty tubes so they can be rotated, both the package cradle of the two-for-one twisting or cabling machine and the package drive roller must be correspondingly modified. The opening in the cover, through which the yarn to be wound is guided to the traversing yarn guide, is adjusted at the traversing stroke in such a way that the yarn is guided to the cover while traversing without contact. The opening may not be too large in its dimensions, as this would have unsuitable effects, for example, on the contamination of the machine parts positioned under the cover, so that the opening must be adjusted accordingly for a specific traversing stroke. If the yarn is transferred to the twisting package with a traversing stroke of 11 inches, a running length increase for the downstream processes of 10% is achieved.

It is conceivable in the context of the invention that a standard spindle pot, or an (also known) so-called energy-saving pot is used at such a workstation. With such an energy-saving pot, the lower pot area approximates to the natural yarn balloon curve when compared with cylindrical spindle pots, and the yarn balloon rotates nearer to the spindle pot. This results in an overall smaller yarn balloon diameter, which has the effect of significantly reducing energy consumption for the operation of the workstation.

In an advantageous design, an empty tube with a length of approximately 340 mm is mountable in the package cradle and the traversing stroke is 12 inches.

With a traversing stroke of 12 inches on an empty tube of at least 340 mm in length, 20% more yarn can be wound onto the twisting package than was previously possible with the standard empty tubes and a traversing stroke of 10 inches, adhering to the maximum diameter for the twisting package of 400 mm.

Alternatively, an empty tube with a length of at least 365 mm is rotatable in the package cradle and the traversing stroke is 13 inches.

With such an empty tube, a traversing stroke of 13 inches can achieve an increase in the running length of the yarn on the twisting package of 30%.

A second aspect of the invention therefore comprises a two-for-one twisting or cabling machine, including a winding device that has a package cradle with two frame arms for the rotatable mounting of an empty tube or twisting package, a package drive roller for frictionally driving a twisting package, a yarn traversing device for the traversing transfer of a yarn to the twisting package, an advance roller for regulating a yarn tension as well as a cover in the area of the advance roller with an opening for the yarn guided through the yarn traversing device.

A characteristic of the two-for-one twisting or cabling machine is that it has at least one workstation that is configured as discussed herein.

With such a design of a two-for-one twisting or cabling machine, twisting packages can be produced that have more yarn when compared with the usual standardized cable packages. The thereby lengthened process running times of the two-for-one twisting or cabling processes not only increase the efficiency but also, due to the less frequently necessary switching processes of the feed packages and the twisting package, have a positive effect on the energy balance of the two-for-one twisting or cabling machine, which then needs to be started up from an idle state less often.

The increased running lengths on the twisting packages also have a very positive effect on the downstream further processing steps, for which the running times are also increased. Longer running times also mean fewer interruptions for manual switch processes for the packages to be processed, which finally relieves the operator of effort.

A third aspect of the invention comprises a method for operating a two-for-one twisting or cabling machine comprising a winding device that has a package cradle with two frame arms for the rotatable mounting of an empty tube or twisting package, a package drive roller for frictionally driving a twisting package, a yarn traversing device for the traversing transfer of a yarn to the twisting package, an advance roller for regulating a yarn tension as well as a cover in the area of the advance roller with an opening for the yarn guided through the yarn traversing device to the twisting package.

For an increase in the running length of the twisting package by 10%, the yarn traversing device must be able to perform a traversing stroke of 11 inches. For an increase in running length of 20%, a traversing stroke of 12 inches is required, and for an increase in running length of 30%, a traversing stroke of 13 inches is required. Depending on the oscillation hub, the length of the empty tube must be selected. Apart from the yarn traversing device, the package cradle, the package drive roller and the cover with the opening for the traversing yarn must be designed accordingly in order to be able to rotate, drive and transfer the yarn with this length format.

In order to further optimize the two-for-one twisting and cabling process of a two-for-one or cabling machine for manufacturing a twisting package, it is conceivable within the context of the invention to combine the enlarged traversing stroke with a processing ratio of the two feed packages of 1:1. This means that during the cabling process, both the feed package in the creel and the feed package positioned in the spindle pot are coordinated so that they have the same running length. In the case of a two-for-one twisting process, both feed packages can also be positioned in the spindle pot. The important thing is that through the complete processing of the feed packages, one or more complete twisting packages are produced.

The running lengths of the feed packages correspond either to half or to a whole number multiple of the twisting package to be produced. In this way, manual intervention is reduced, the process running times are further optimized and the occurrence of yarn remnants is avoided.

Another possible option is to combine the enlarged traversing stroke with a spindle pot, the dimensions of which are optimized for the diameter of the feed package, so that the optimal exploitation of volume is achieved. In this way, the corresponding machine elements with regard to the spindle or spindle pot can be designed so that the energy consumption is as low as possible. This is already realized, for example, through a so-called energy-saving pot, the lower area of which is tapered, allowing for a spindle with a smaller diameter.

With the help of this procedure, twisting packages with increased running lengths can be manufactured. This not only has a positive effect on the two-for-one twisting and cabling process, but also on the downstream further processing steps. Particularly because the advantages of the longer process running times in further processing can be achieved without costly machine conversion measures. Both the feed packages and the further processing textile machines can continue to be used with the standardized dimensions for the new type of twisting packages.

Further features and advantages of the invention are evident from the following description of preferred embodiment examples of the invention, on the basis of the figures and drawings illustrating details essential to the invention, and from the claims. The individual features can be implemented individually or in any desired combination in a preferred embodiment of the invention.

BRIEF DESCRIPTION OF THE DRAWINGS

In the following, the invention is explained in more detail below on the basis of an exemplary embodiment(s) with reference to the accompanying drawings, wherein.

DESCRIPTION OF THE PREFERRED EMBODIMENTS

Figure 1:
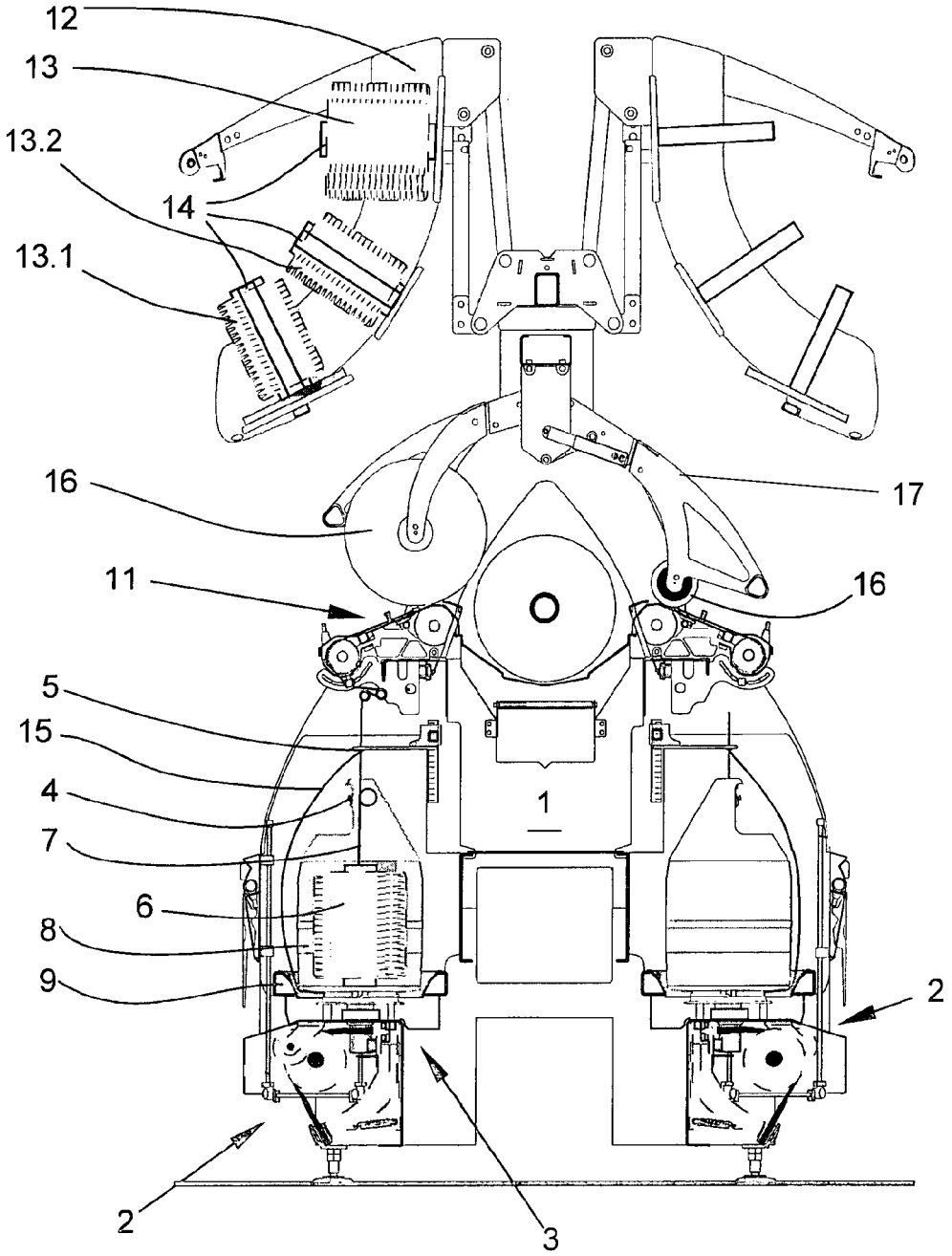
FIG. 1 is a schematically presented cross-section of a cabling machine.
Figure 3:
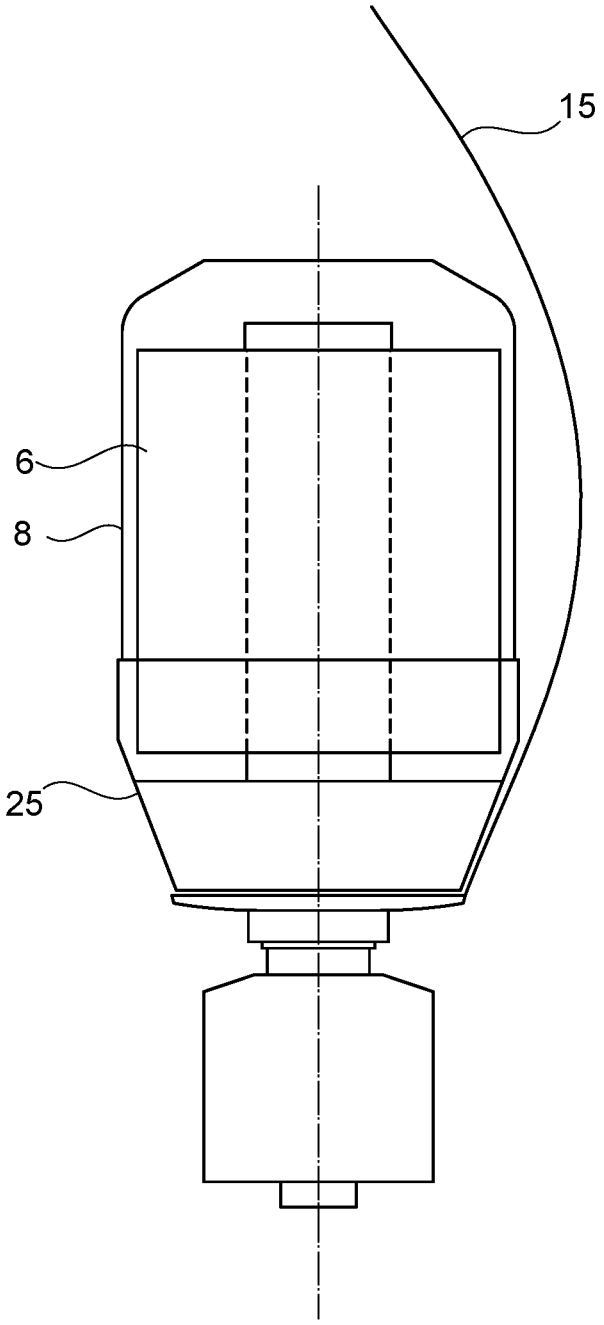
FIG. 3 is a schematically presented view of the tapered lower area of a spindle pot of the cabling machine of FIG. 1.

In FIG. 1, a schematic cross-section view of a cabling machine 1 is depicted, that has a number of workstations 2 positioned next to each other in the running direction of the machine. The workstations 2 each comprise a cabling spindle 3 with a spindle pot 8, the lower area of which is tapered 25 as seen in FIG. 3, as well as a drivable yarn storage disc 9 positioned below the spindle pot 8. A yarn brake 4 and a balloon guide 5 are positioned above the cabling spindle 3. The spindle pot 8 serves to take up an initial feed package 6 from which an inner yarn 7 is drawn over the head. The inner yarn 7 of the first feed package 6 is guided over the yarn brake 4 to the balloon guide 5.

Each workstation 2 has a feed device for feed packages located outside the spindle pot 8, a so-called creel 12, which is installed to take up at least one further feed package 13.

The creel 12 has several mandrels 14 in this embodiment example. An external yarn 15 is drawn from a second feed package 13 positioned on the creel 12, which is guided axially from below through the hollow axle of the cabling spindle 3. The external yarn 15 coming from the second feed package 13 is turned around in a radial direction and exits to the yarn storage disc 9 below the first feed package 6 from the hollow axle of the cabling spindle 3. The yarn storage disc 9 is turned via the cabling spindle 3. The external yarn 15 exiting from the yarn storage disc 9 rotates around the spindle pot 8 and is guided through the balloon guide 5. The inner yarn 7 and external yarn 15 combined in the balloon guide 5 form a cabled double yarn, while the external yarn 15 coming from the second feed package 13 winds around the inner yarn 7 coming from the first feed package 6. The double yarn thus created is guided to a winding device 11 and wound into a take-up or twisting package 16.

Two feed packages 6, 13 are used for producing a twisting package 16 with a diameter of 400 mm. The first feed package 6 is brought into the spindle pot 8, the second feed package 13 is put onto a mandrel 14 of the creel 12. The unwinding process of both of the feed packages 6 and 13 ends when the pre-specified completion diameter of the twisting package 16 is reached.

At the point of completion, yarn is drawn from both of the feed packages 6 and 13 in equal amounts, so that, in this embodiment example, both feed packages are approximately half unwound. The twisting package 16 is removed and a new empty tube is fixed. In addition, the package cradle 17 must be manually raised, so that the twisting package 16 is lowered by the package drive roller 19. In order to be able to handle the higher weight of the twisting package 16 with the package cradle 17 better due to the higher running length, the package cradle 17 can be attached at both sides, i.e. at each frame arm and rotated into an upper locking position. Finally, a new twisting package 16 is produced.

The feed packages can, for example, alternatively have half the yarn amount of the twisting package 16 to be produced. Such alternative twisting packages are designated with the references 13.1 and 13.2. In this case, at the time of completion of the twisting package 16, both feed packages 6 and 13.1 or 13.2 are completely unwound except for a small remnant of yarn. The unwound feed packages 6 and 13.1 or 13.2 are then replaced with new ones.

Figure 2:
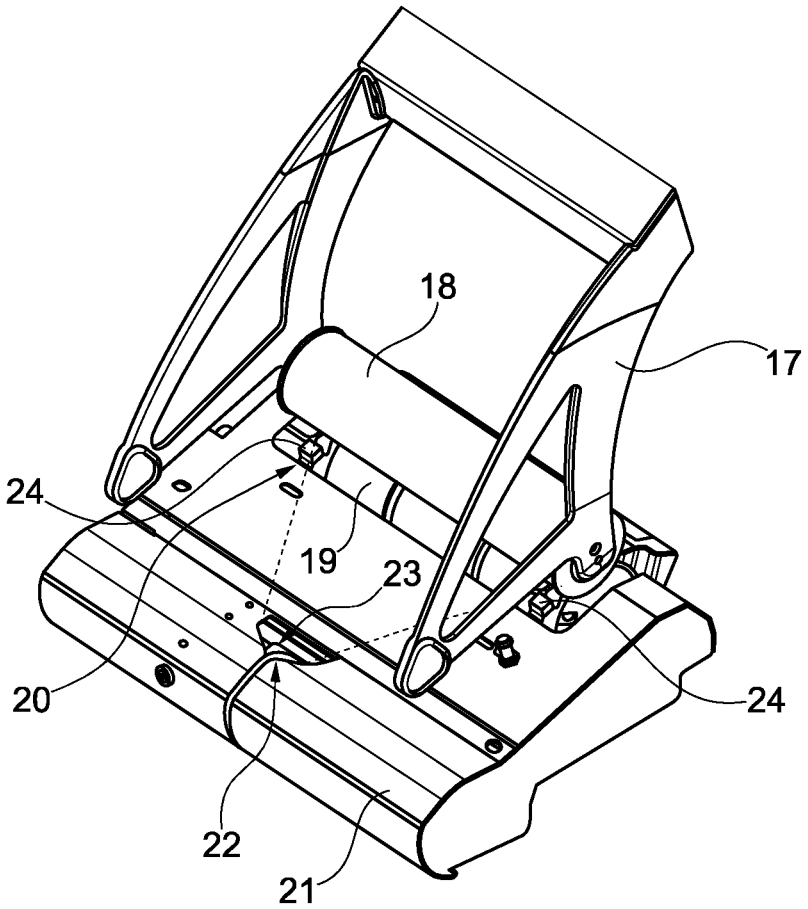
FIG. 2 is a schematically presented view of a winding device.

FIG. 2 shows a schematic illustration of the winding device 11 of a workstation 2. The movable, spring-mounted package cradle 17 is designed so that an empty tube 18 with a length of 340 mm is rotatable. The cabled yarn is wound onto the empty tube 18 for producing the twisting package 16. In addition, the empty tube 18 is driven by means of friction with a package drive roller 19. The yarn traversing device 20, depicted in this embodiment example as yarn guide 24, is designed to perform a traversing stroke of 12 inches.

An advance roller 23, covered by the cover 21, regulates the yarn tension of the yarn to be wound onto the twisting package 16. The yarn is led to the yarn guide 24 through the cover 21, which has an opening 22 for this purpose.

The path of the yarn to the yarn guide 24 in its most extreme right position, which is ideally imagined as a straight line, is represented as a dashed line. Accordingly, the path of the yarn to the yarn guide 24 in its most extreme left position is also represented as an ideal straight line. This means that, for both of the thread guides represented, they are not separate components, instead the same yarn guide 24 is represented in its two extreme positions, which executes a traversing stroke of 12 inches on its way between these two positions, in order to produce a twisting package 16 with a 20% greater running length.

LIST OF REFERENCE NUMBERS

1 Cabling machine
2 Workstation
3 Cabling spindle

4 Yarn brake
5 Balloon guide
6 First feed package
7 Inner yarn
8 Spindle pot
9 Yarn storage disc
11 Winding device
12 Creel
13 Second feed package
13.1 Alternative feed package
13.2 Alternative feed package
14 Mandrel
15 Outer yarn
16 Twisting package
17 Package cradle
18 Empty tube
19 Package drive roller
20 Yarn traversing device
21 Cover
22 Opening
23 Advance roller
24 Yarn guide
25 Tapered lower area It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A workstation of a two-for-one twisting or cabling machine for the production of carpet yarn, comprising a winding device that has a package cradle with two frame arms for rotatable mounting of an empty tube or twisting package, a package drive roller for frictionally driving a twisting package, a yarn traversing device for traversing transfer of a yarn to the twisting package, an advance roller for regulating a yarn tension as well as a cover in the area of the advance roller with an opening for the yarn guided through the yarn traversing device to the twisting package, characterised in that, the package cradle has at least one movable, partially rotatable frame arm and is designed so that the empty tube with a length of at least 315 mm can be inserted, the package drive roller has a length of at least 286 mm, the yarn traversing device has a traversing stroke of at least 11 inches, and the opening in the cover corresponds with the yarn progress occurring through the traversing stroke, and the twisting package is fed from a first feed package and a second feed package, and running lengths of the first and second feed packages correspond either to a half or to a whole number multiple of the twisting package to be produced.

2. The workstation of a two-for-one twisting or cabling machine according to claim 1, characterised in that, in the package cradle the empty tube can be positioned, wherein the empty tube has a length of at least 340 mm, and the traversing stroke is 12 inches.

3. The workstation of a two-for-one twisting or cabling machine according to claim 1, characterised in that, in the package cradle the empty tube can be positioned, wherein the empty tube has a length of at least 365 mm, and the traversing stroke is 13 inches.

4. A two-for-one twisting or cabling machine, including a winding device that has a package cradle with two frame arms for rotatable mounting of an empty tube or twisting package, a package drive roller for frictionally driving a twisting package, a yarn traversing device for traversing transfer of a yarn to the twisting package, an advance roller for regulating a yarn tension as well as a cover in the area of the advance roller with an opening for the yarn guided through the yarn traversing device to the twisting package, characterised in that, the two-for-one twisting or cabling machine has at least one workstation that is configured according to claim 1.

5. A method for operating a two-for-one twisting or cabling machine comprising a winding device that has a package cradle with two frame arms for rotatable mounting of an empty tube or twisting package, a package drive roller for frictionally driving a twisting package, a yarn traversing device for traversing transfer of a yarn to the twisting package, an advance roller for regulating a yarn tension as well as a cover in the area of the advance roller with an opening for the yarn guided through the yarn traversing device to the twisting package, characterised in that, the empty tube is inserted into the package cradle, wherein the empty tube comprises a length of at least 315 mm, the thread is laid with a traverse stroke of at least 11 inches, and the twisting package is fed from a first feed package and a second feed package, and running lengths of the first and second feed packages correspond either to a half or to a whole number multiple of the twisting package to be produced.

6. The workstation according to claim 1, wherein the traversing stroke is combined with a spindle pot.

7. The workstation according to claim 6, wherein the spindle pot has a lower area of which is tapered.

8. A workstation of a two-for-one twisting or cabling machine for the production of carpet yarn, comprising a winding device that has a package cradle with two frame arms for rotatable mounting of an empty tube or twisting package, a package drive roller for frictionally driving a twisting package, a yarn traversing device for traversing transfer of a yarn to the twisting package, an advance roller for regulating a yarn tension as well as a cover in the area of the advance roller with an opening for the yarn guided through the yarn traversing device to the twisting package, characterised in that, the package cradle has at least one movable, partially rotatable frame arm and is designed so that the empty tube with a length of at least 315 mm can be inserted, the package drive roller has a length of at least 286 mm, the yarn traversing device has a traversing stroke of at least 11 inches, and the opening in the cover corresponds with the yarn progress occurring through the traversing stroke, and the twisting package is fed from a first feed package and a second feed package, and running lengths of the first and second feed packages correspond either to a half or to a whole number multiple of the twisting package to be produced, and wherein a processing ratio of the first and second feed packages is 1:1.

9. The workstation according to claim 6, wherein the first feed package and the second feed package are positioned in the spindle pot.

* * * * *